US006694958B2

(12) United States Patent
Hiramatsu et al.

(10) Patent No.: US 6,694,958 B2
(45) Date of Patent: Feb. 24, 2004

(54) IGNITION DEVICE FOR INTERNAL COMBUSTION ENGINE

(75) Inventors: Hiromi Hiramatsu, Kariya (JP); Masamichi Shibata, Toyota (JP); Tetsuya Miwa, Nagoya (JP); Takeo Maekawa, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/389,969

(22) Filed: Mar. 18, 2003

(65) Prior Publication Data

US 2003/0183214 A1 Oct. 2, 2003

(30) Foreign Application Priority Data

Apr. 1, 2002 (JP) ..... 2002-098508

(51) Int. Cl.[7] ..... F02P 13/00
(52) U.S. Cl. ..... 123/634; 123/635; 336/219
(58) Field of Search ..... 123/634, 635; 336/219, 211

(56) References Cited

U.S. PATENT DOCUMENTS

| | | | | |
|---|---|---|---|---|
| 6,112,730 | A * | 9/2000 | Marrs et al. | 123/635 |
| 2003/0070665 | A1 * | 4/2003 | Paul et al. | 123/635 |
| 2003/0127080 | A1 * | 7/2003 | Sexton | 123/634 |

FOREIGN PATENT DOCUMENTS

| | | |
|---|---|---|
| EP | 907019 | 4/1999 |
| JP | 2000-252040 | 9/2000 |
| JP | 2000-277232 | 10/2000 |

* cited by examiner

*Primary Examiner*—Erick Solis
(74) *Attorney, Agent, or Firm*—Nixon & Vanderhye P.C.

(57) ABSTRACT

In an ignition device for an internal combustion engine, comprising a spark plug made to carry out an electric discharge between an center electrode and an earth electrode and an ignition coil having a primary winding and a secondary winding for supplying a high voltage to the spark plug, notch portions are made in a ceramic spool on which one of the primary and secondary windings is wound and projecting portion are made in an insulating-resin-made holding member into which connector terminals are incorporated, with the projecting portions being engaged with the notch portions. The engagement of the projecting portions and the notch portions prevents the connector terminals from moving with respect to the ceramic spool in circumferential directions of the ceramic spool during terminal connection work. This solves the problems in that, in the case of the employment of a ceramic spool, because difficulty is encountered in insert-molding the connector terminals in the ceramic spool, the connector terminals can move with respect to the ceramic spool during terminal connection work for the connection of the winding to the connector terminals to cause poor terminal connection workability.

3 Claims, 4 Drawing Sheets

IGNITION DEVICE FOR INTERNAL COMBUSTION ENGINE

BACKGROUND OF THE INVENTION

1) Field of the Invention

The present invention relates to an ignition device for use in an internal combustion engine, which has an integral construction of an ignition plug and an ignition coil.

2) Description of the Related Art

So far, as ignition devices for use in internal combustion engines, there have been proposed various types (see Japanese Patent Laid-Open Nos. 2000-252040 and 2000-277232 and European Patent Laid-Open No. 0907019). In such types of ignition devices, each of primary and secondary windings is wound around a resin-made spool and a connector terminal, to which connected is an end portion (terminal) of the winding, is insert-molded in a resin-made spool.

Meanwhile, the present inventors have studied the replacement of one of the two spools with a ceramic spool and an integral construction of a plug side tube section, internally including a center electrode and a stem, and the ceramic spool for the purpose of the cost reduction based on the structural simplification. However, this has indicated the following problems.

That is, in the case of a conventional resin-made spool, a connector terminal is insert-molded in the spool to inhibit motions of the connector terminal with respect to the spool, which can facilitate the terminal connection work for the connection between an end portion of a winding and the connector terminal.

However, for a spool to be of a ceramics-made type, difficulty is experienced in insert-molding a connector terminal in a spool, which leads to arbitrary motions of the connector terminal with respect to the spool during the terminal connection work, thereby creating a problem in the impairment of workability of terminal connection.

SUMMARY OF THE INVENTION

The present invention has been developed with a view to eliminating the above-mentioned problem, and it is therefore an object of the invention to eliminate problems occurring in the case of the employment of a ceramic spool in an ignition device for an internal combustion engine in which a spark plug and an ignition coil are integrated with each other and is mounted in a cylinder head.

For this purpose, in accordance with the present invention, there is provided an ignition device for an internal combustion engine, which is equipped with a spark plug (2) made to carry out an electric discharge between an center electrode (22) and an earth electrode (23) and an ignition coil (3) having a primary winding (31) and a secondary winding (32) for supplying a high voltage to the spark plug (2), with the spark plug (2) and the ignition coil (3) being mounted in a cylinder head of the internal combustion engine in an integrated condition, the ignition device comprising a tube-like ceramic spool (52) on which one of the primary winding (31) and the secondary winding (32) is wound, two conductive connector terminals (61) located at an axial end portion of the spool (52) and connected to both end portions **(31*a*) of the winding (31) wound on the spool (52), an insulating-resin-made holding member (9) into which the two connector terminals (61) are incorporated, and positioning means (55, 92) for inhibiting a relative motion of the connector terminals (61) and the holding member (9) with respect to the spool (52) in circumferential directions of the spool (52)**.

This inhibits the motion or movement of the connector terminals with respect to the ceramic spool in the circumferential directions of the spool during the terminal connection work for establishing the connection between the windings and the connector terminals, thus improving the workability or work efficiency of the terminal connections.

In addition, according to the present invention, it is also appropriate that the positioning means (55, 92) comprises a notch portion made in the spool (52) and a projecting portion (92) made in the holding member (9) to engage with the notch portion (55). This contributes to the facilitation of the construction of the ignition device according to the present invention.

Still additionally, according to the present invention, it is also appropriate that the spool (52) is integrated with a ceramics-made plug side tube section (51) internally accommodating the center electrode (22). This contributes to the facilitation of the construction of the ignition device according to the present invention, thereby achieving the cost reduction.

The reference numerals in parentheses attached to the respective means or members signify the corresponding relation with respect to the concrete means in an embodiment which will be described later.

BRIEF DESCRIPTION OF THE DRAWINGS

Other objects and features of the present invention will become more readily apparent from the following detailed description of the preferred embodiments taken in conjunction with the accompanying drawings in which.

DESCRIPTION OF THE PREFERRED EMBODIMENTS

Figure 1:
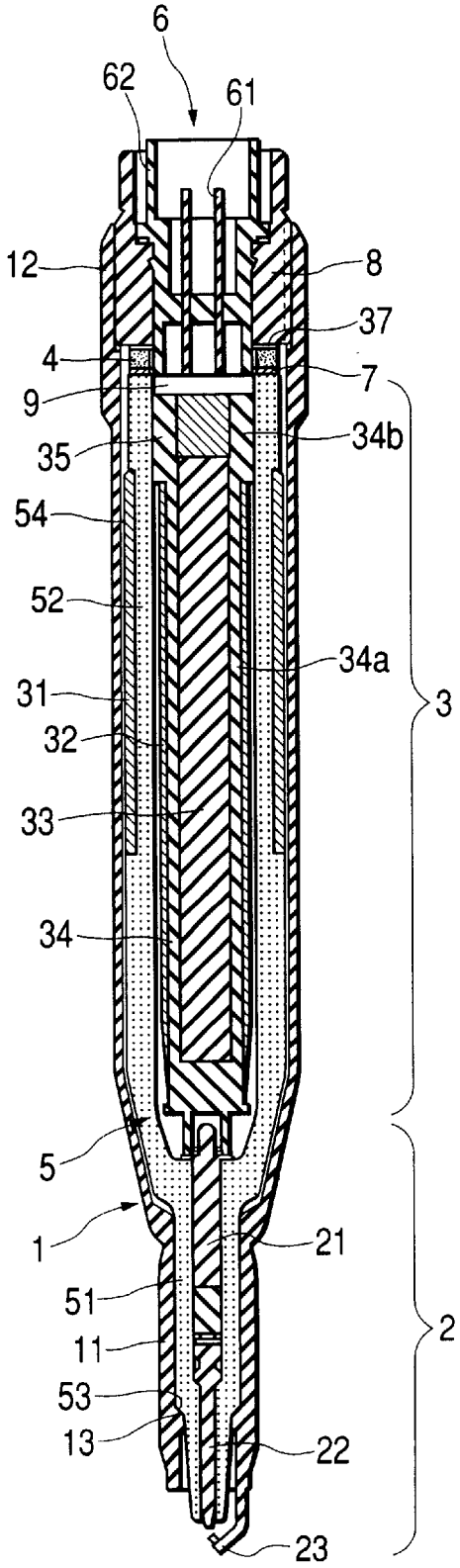
FIG. 1 is a front-elevational cross-sectional view showing an ignition device for an internal combustion engine according to an embodiment of the present invention.
Figure 2:
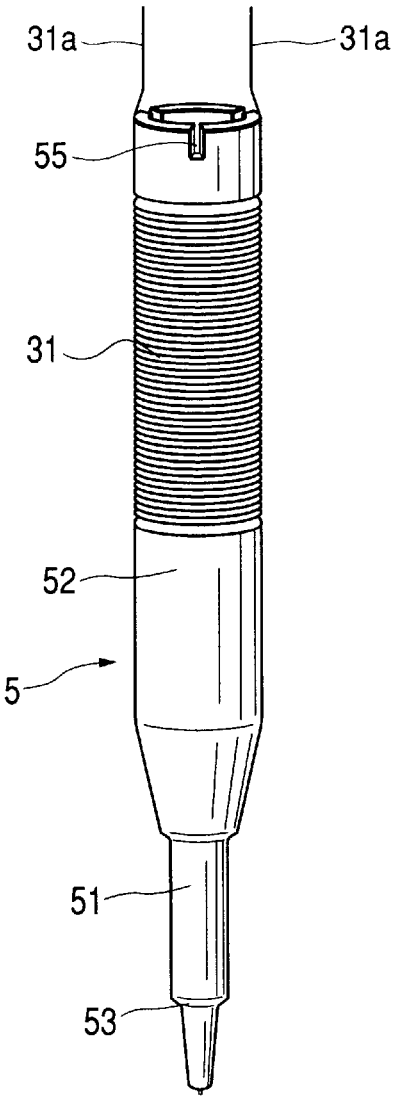
FIG. 2 is a perspective view showing an insulator on which a primary winding shown in FIG. 1 is wound.
Figure 3:
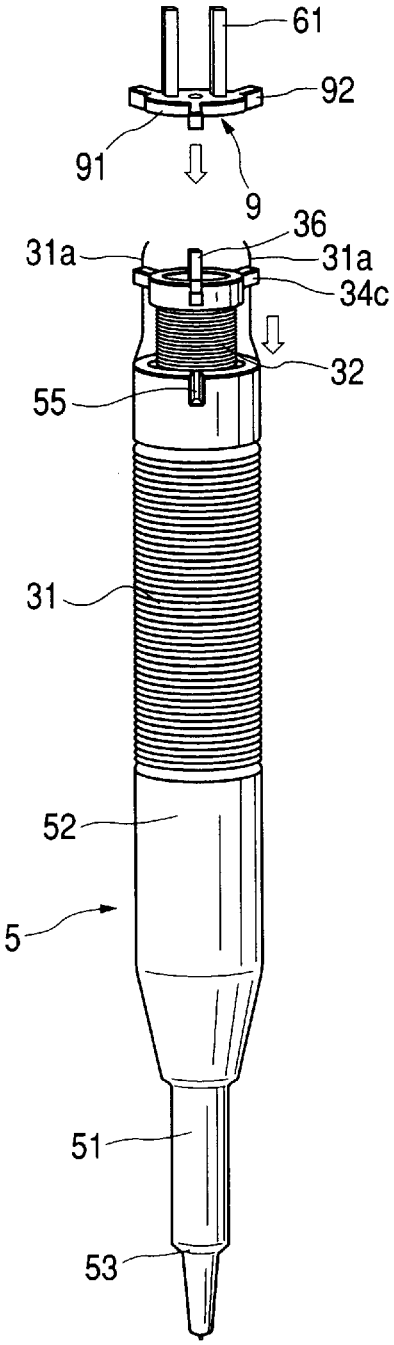
FIG. 3 is an exploded perspective view useful for explaining an incorporation process for an ignition coil section shown in FIG. 1.
Figure 4:
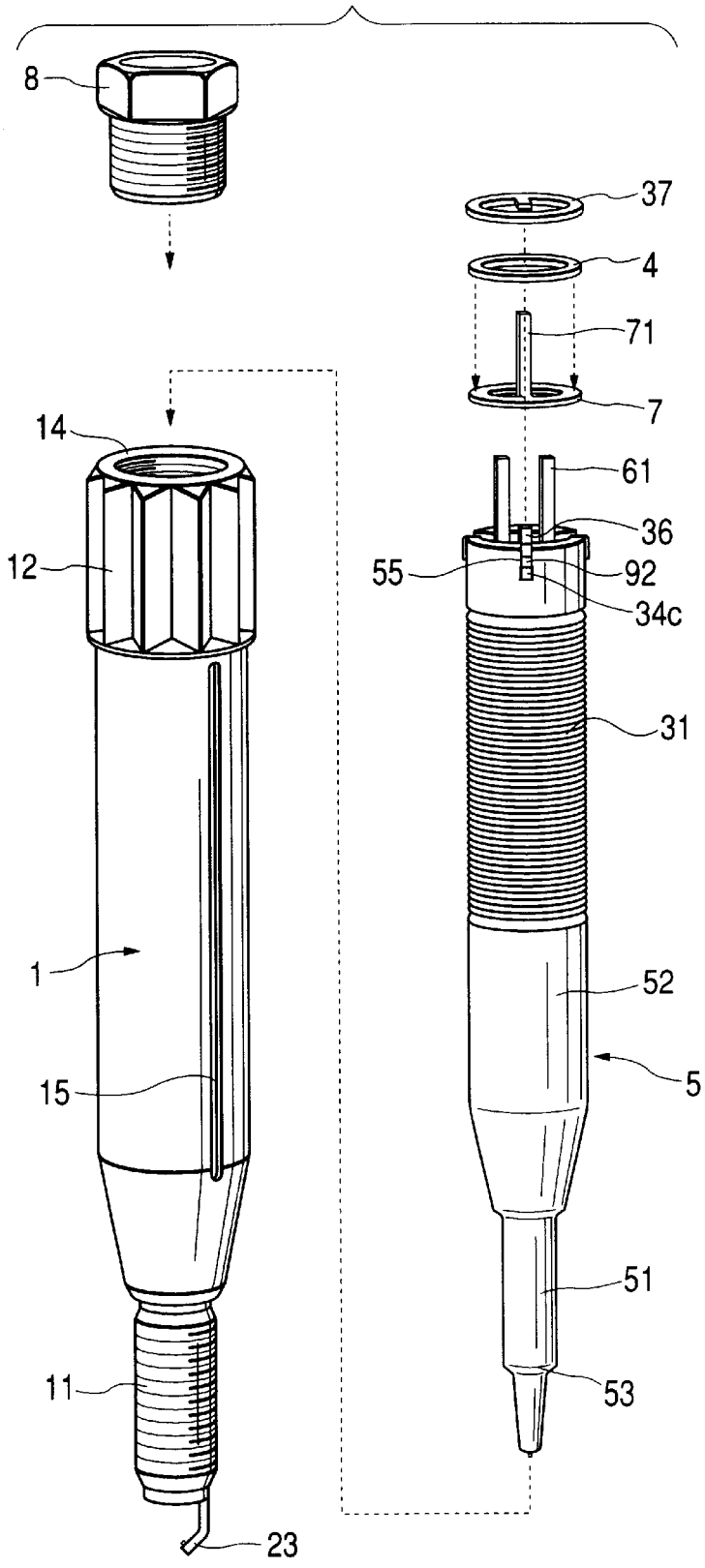
FIG. 4 is an exploded perspective view useful for explaining an incorporation process for the ignition device shown in FIG. 1.
Figure 5:
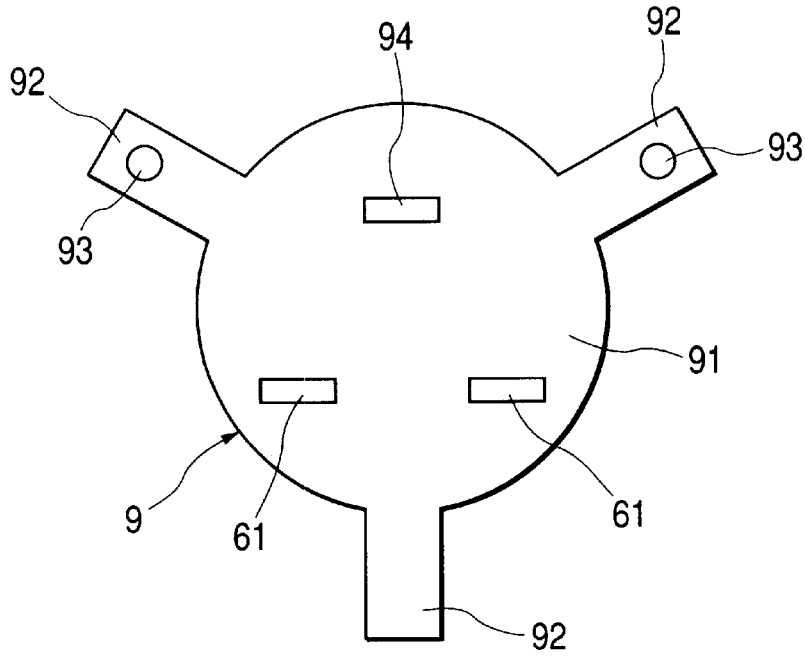
FIG. 5 is a plan view showing connector terminals for a primary winding and a holding plate shown in FIG. 1.
Figure 6:
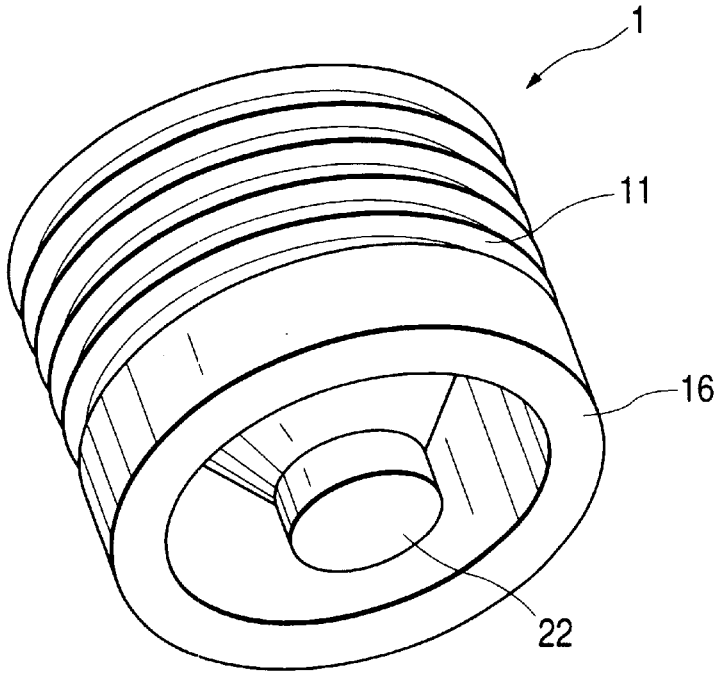
FIG. 6 is a perspective view showing an essential part of an ignition device according to another embodiment.

FIGS. 1 to 5 are illustrations of an ignition device for use in an internal combustion engine according to an embodiment of the present invention. FIG. 1 is a cross-sectional view showing the entire construction of the ignition device, FIG. 2 is a perspective view showing an insulator 5 on which a primary winding 31 is put in a wound condition, FIG. 3 is an exploded perspective view useful for explaining an incorporation process for an ignition coil 3 section, FIG. 4 is an exploded perspective view useful for explaining an incorporation process for the ignition device, and FIG. 5 is a plan view showing connector terminals 61 for the primary winding 31 and a holding plate 9.

In FIG. 1, the ignition device is designed such that a cylindrical case 1 accommodates a spark plug 2, an ignition coil 3 and a pressure detecting element 4, and is mounted in a plug hole of a cylinder head so that both electrodes of the spark plug 2 (which will be mentioned in detail later) are exposed to a combustion chamber of an internal combustion engine for a motor vehicle.

The case 1 is made of a magnetic and conductive metallic material, more concretely, is made of a steel material such as a carbon steel, and in an outer circumferential surface of the case 1, a male screw portion 11 is made on the combustion chamber side while a tightening nut portion 12 is made on a side opposite to the combustion chamber side. The case 1 is rotated through the use of the nut portion 12 so that the male screw portion 11 engages with a female screw portion (not shown) of the cylinder head, thus fixedly securing the ignition device to the cylinder head.

In the case 1, there is accommodated a cylindrical insulator 5 made of ceramics such as alumina having a sufficient electrical insulating property. This insulator 5 is equipped with a plug side tube section 51 positioned on the combustion chamber side and a coil side tube section 52 extending from the plug side tube section 51 to the side opposite to the combustion chamber side.

On an inner circumferential surface of the case 1, a stepped receiving surface 13 is formed in the vicinity of the combustion chamber side, and on an outer circumferential surface of the plug side tube section 51 of the insulator 5, a stepped working (contacting) surface 53 is formed to come into contact with the receiving surface 13. Moreover, in a state where the receiving surface 13 and the working surface 53 are brought into contact with each other, the case 1 and the insulator 5 are positioned in an axial direction and the leakage of the combustion gas from a portion between the case 1 and the insulator 5 is preventable.

The spark plug 2 is composed of a stem 21 made of a conductive metal, a center electrode 22 made of a conductive metal, an earth electrode 23 made of a conductive metal, and others. The stem 21 and the center electrode 22 are inserted into a central hole of the plug side tube section 51 of the insulator 5, and one end portion of the center electrode 22 is exposed to the combustion chamber. Moreover, the earth electrode 23 is integrated with the case 1 by means of welding or the like, and this earth electrode 23 is positioned to be in opposed relation to the one end portion of the center electrode 22.

The ignition coil 3 is composed of a primary winding 31, a secondary winding 32, a cylindrical center core 33 made of a magnetic material, a secondary spool 34 made of an electrical insulating resin and formed into a blind-end type cylindrical configuration, and others.

The primary winding 31 is directly wound around a recess portion 54 of the coil side tube section 52 of the insulator 5. This coil side tube section 52 corresponds to a tubular ceramic spool (made of ceramics) on which a winding is wound. Moreover, both end portions (terminals) of the primary winding 31 are connected to two primary winding connector terminals 61 of a connector 6 for connection by means of soldering or fusing and, hence, a current is supplied from an igniter (not shown) to the primary winding 31. The terminal connection work will be mentioned later.

In the case 1, a section surrounding the center core 33 functions as an outer circumferential core in which a magnetic flux flows, and a magnetic flux generated in the primary winding 31 flows through the center core 33 and the case 1.

In addition, in the case 1, the section surrounding the center core 33 has a slit 15 (see FIG. 4) formed to extend in an axial direction of the center core 33 for the purpose of preventing a loss stemming from a ring current developing due to a magnetic flux variation.

The secondary spool 34 is equipped with a winding tube section 34*a* on which the secondary winding 32 is wound and a protruding tube section 34*b* protruding from the winding tube section 34*a* toward the side opposite to the combustion chamber side. The secondary winding 32 is wound on an outer circumference of the winding tube section 34*b* and the center core 33 is inserted into a central hole of the secondary spool 34. A core pressing cover 35 made of an elastic material such as a rubber or sponge is inserted into an opening of the central hole of the secondary spool 34 to fill up the central hole of the secondary spool 34.

A high-voltage end portion of the secondary winding 32 is electrically connected through the stem 21 of the spark plug 2 to the center electrode 22. On the other hand, a low-voltage end portion of the secondary winding 32 is electrically connected through parts, i.e., a ground terminal 36 (see FIG. 3), a ground plate 37 and a bolt 8, placed in the interior of the case 1, to the case 1, and is further electrically connected through the case 1 to the earth electrode 23. In other words, the low-voltage end portion of the secondary winding 32 is electrically connected to the earth electrode 23 without being connected through the internal combustion engine.

The ground terminal 36 is made of a conductive metal and formed into a plate-like or bar-like configuration, with one end portion thereof being connected to the low-voltage end portion of the secondary winding 32. The ground plate 37 is made of a conductive metal and includes a sheet ring portion and an insert portion protruding inwardly from the ring portion, and the ring portion is located between the pressure detecting element 4 and the bolt 8 and the ground terminal 36 is inserted into a hole of the insert portion.

The pressure detecting element 4 shows a fluctuation of electric potential in accordance with a variation of a load applied thereto, and is made of, for example, lead titanate and is formed into a sheet ring-like configuration. Moreover, the pressure detecting element 4 is located at an end portion of the coil side tube section 52, with one end portion of the pressure detecting element 4 being electrically connected through the ground plate 37, the bolt 8 and the case 1 to the cylinder head.

In addition, a combustion pressure signal terminal 7 formed into a sheet ring-like configuration is located between the pressure detecting element 4 and the coil side tube section 52. This combustion pressure signal terminal 7 is integrated with a combustion pressure signal connector terminal 71 (see FIG. 4). Thus, an output signal of the pressure detecting element 4 is fed to a control unit (not shown).

In this connection, for allowing the pressure detecting element 4 to be located at the end portion of the coil side tube section 52, the end portion of the coil side tube section 52 is made to extend upwardly with respect to the primary winding 31 and the secondary winding 32 on the paper surface of FIG. 1. In other words, the end portion of the coil side tube section 52 is made to protrude toward the side opposite to the combustion chamber with respect to the primary winding 31 and the secondary winding 32.

The bolt 8 is made of a conductive metal and formed into a tube-like configuration. The bolt 8 is screw-engaged with the female screw portion 14 made in the case 1 on the side opposite to the combustion chamber so that the ground plate 37, the pressure detecting element 4 and the combustion pressure signal terminal 7 are held between the end portion of the coil side tube section 52 and the bolt 8.

In addition, by tightening the bolt 8, a compression preload is applied to the pressure detecting element 4, and a packing (not shown) is put in a contact portion between the receiving surface 13 of the case 1 and the working surface 53 of the insulator 5 to prevent the leakage of the combustion gas from between the case 1 and the insulator 5.

After the bolt 8 is screw-engaged with the female screw portion 14, a resin-made case 62 of the connector 6 is inserted into a hollow of the bolt 8.

Secondly, a description will be given hereinbelow of a positioning construction for the secondary spool 34, the primary winding connector terminal 61 and others with respect to the insulator 5, a method of assembling these members and a terminal connection work for the primary winding 31.

As FIG. 2 shows, in the coil side tube section 52, three notch portions 55 are made in its end portion opposite to the combustion chamber side, and these notch portions 55 are arranged at an equal interval along a circumferential direction of the coil side tube section 52. Moreover, both the end portions 31*a* of the primary winding 31 are drawn out toward the end portion of the coil side tube section 52 opposite to the combustion chamber side and are temporarily fixed at a predetermined position in the circumferential direction of the coil side tube section 52 through the use of a tape or the like.

As FIG. 3 shows, in the secondary spool 34, three projecting portions 34*c* are made in its end portion opposite to the combustion chamber side to engage with the notch portions 55 of the coil side tube section 52. In two of the three projecting portions 34*c*, through holes (not shown) are made to accommodate the end portions 31*a*, respectively.

In addition, as shown in FIGS. 3 and 5, the two primary winding connector terminals 61, made of a conductive metal, are insert-molded in a disc portion 91 of the holding plate 9 made of an insulating resin so that the two primary winding connector terminals 61 and the holding plate 9 are formed into an integrated construction. Still additionally, in an outer circumference of the disc portion 91, three projecting portions 92 are made to engage with the notch portions 55 of the coil side tube section 52. Yet additionally, through holes 93, which accommodate the end portions 31*a* of the primary winding 31, are made in two of the three projecting portions 92, and a through hole 94, which accommodates the ground terminal 36, is made in the disc portion 91.

The holding plate 9 corresponding to a holding member, and the notch portions 55 of the coil side tube section 52 and the projecting portions 92 of the holding plate 9 correspond to positioning means.

In assembling, as shown in FIG. 3, the secondary spool 34 in which the secondary winding 32, the center core 33 and the core pressing cover 35 are built is first inserted halfway into the central hole of the insulator 5 and the end portions 31*a* are then inserted into the through holes of the projecting portions 34*c* of the secondary spool 34. Subsequently, as shown in FIG. 4, the secondary spool 34 is further pushed into the central hole of the insulator 5 so that the projecting portions 34*c* engage with the notch portions 55 of the coil side tube section 52.

Following this, the end portions 31*a* are inserted into the through holes 93 of the holding plate 9 and the projecting portions 92 of the holding plate 9 are then engaged with the notch portions 55 of the coil side tube section 52 as shown in FIG. 4. This engagement between the projecting portions 92 and the notch portions 55 inhibits or limits the relative movement between the coil side tube section 52 and the primary winding connectors 61 and/or the holding plate 9 in circumferential directions of the coil side tube section 52.

Moreover, the terminal connection work is done in a state where the relative movement is inhibited in this way. That is, the end portions 31*a* are connected to the primary winding connector terminals 61 by means of soldering or fusing.

Thereafter, the insulator 5, together with the combustion pressure signal terminal 7, the pressure detecting element 4 and the ground plate 37 built in the insulator 5, is inserted into the case 1 and after the insertion thereof into the case 1, the bolt 8 is tightened with respect to the female screw portion 14. Moreover, after the bolt 8 is screw-coupled with the female screw portion 14, the resin-made case 62 of the connector 6 is inserted into the hollow of the bolt 8, thus completing the assembling.

In the ignition device constructed as mentioned above, in response to the supply of a current from an igniter, the ignition coil 3 develops a high voltage, and the spark plug 2 discharges the high voltage in a spark gap to ignite an air-fuel mixture in the interior of the combustion chamber. Moreover, the pressure variation produced by the combustion in the combustion chamber is transmitted through the insulator 5 to the pressure detecting element 4 so that the pressure detecting element 4 undergoes a load variation. Still moreover, the pressure detecting element 4 outputs a voltage signal corresponding to this load variation.

In this embodiment, since the engagement between the projecting portions 92 of the holding plate 9 and the notch portions 55 of the coil side tube section 52 inhibits the relative movements between the coil side tube section 52 and the primary winding connector terminals 61 and/or the holding plate 9 in the circumferential directions of the coil side tube section 52, during the terminal connection work, the primary winding connector terminals 61 do not move with respect to the coil side tube section 52 in the circumferential directions of the coil side tube section 52, thus improving the workability of the terminal connection.

In addition, since the low-voltage side of the secondary winding 32 and the earth electrode 23 of the spark plug 2 are electrically connected to each other through the case 1, it is possible to eliminate the need for connector terminals and wire harnesses for the low-voltage side of the secondary winding 32 to be electrically connected to the internal combustion engine. This enables the size reduction of the connector 6 and can eliminate the need for the laying of the wire harnesses for making an electrical connection of the low-voltage side of the secondary winding 32 to the internal combustion engine, thus enhancing the reliability of the device.

Still additionally, this shortens the distance between the low-voltage side of the secondary winding 32 and the earth electrode 23 of the spark plug 2 and reduces the number of connection places, thereby reducing the resistance loss of the discharge circuit and enabling efficient ignition.

Yet additionally, one end portion of the pressure detecting element 4 is electrically connected through the case 1 to the internal combustion engine, which eliminates the need for connector terminals and wire harnesses for the one end portion of the pressure detecting element 4 to be electrically connected to the internal combustion engine.

Moreover, since the end portion of the coil side tube section 52 is made to further protrude toward the side opposite to the combustion chamber with respect to the primary winding 31 and the secondary winding 32 and the pressure detecting element 4 is located at the end portion of the coil side tube section 52, signals lines of the pressure detecting element 4 can be derived from the case 1 to the external without being required to pass by the ignition coil 3. Accordingly, there is no need to increase the diameter of the case 1, and the output signal of the pressure detecting element 4 is unsusceptible to the influence of discharge noises from the ignition coil 3, and even the processing such as the laying of the signal lines becomes unnecessary or easy.

Still moreover, since a compression preload is applied to the pressure detecting element 4 by tightening the bolt 8, the output thereof corresponding to the pressure variation in the combustion chamber is attainable with high accuracy.

Yet moreover, since the working surface 53 of the insulator 5 is pressed against the receiving surface 13 of the case 1 by tightening the bolt 8, the contact portion between the receiving surface 13 and the working surface 53 can prevent the combustion gas from leaking between the case 1 and the insulator 5.

Furthermore, since the case 1 and the section accommodating the ignition coil components are formed in an integrated fashion, the heat radiation property of the ignition coil components becomes further improvable, as compared with a type in which the ignition coil components are put in a resin-made case.

Still furthermore, since the case 1 itself has a function as an outer circumferential core of the ignition coil, unlike the conventional art there is no need to place an outer circumferential core separately, which achieves the reduction of the diameter of the ignition device and the cost reduction.

Moreover, since the slit 15 is provided in a section surrounding the center core 33 in the case 1, the loss stemming from a ring current developing due to a magnetic flux variation is avoidable.

Still moreover, since the windings 31, 32 and others of the ignition coil 3 are covered with the metal-made case 1 connected through the cylinder head to the ground, the ignition noises generated in the interior of the ignition coil 3 are shielded by the case 1, thus resulting in less leakage thereof to the external.

(Another Embodiment)

Although in the above-described embodiment the earth electrode 23 is provided as a member distinct from the case 1, it is also appropriate that, without constructing the earth electrode 23 as the member distinct from the case 1, the case 1 itself is used as an earth electrode to make discharge between a combustion chamber side end portion 16 of the case 1 and the center electrode 22.

In addition, although in the above-described embodiment the secondary winding 32 is located on the inner circumferential side and the primary winding 31 is located on the outer circumferential side, the present invention is not limited to this, but it is also acceptable that the secondary winding 32 is put on the outer circumferential side and the primary winding 1 is put on the inner circumferential side.

Still additionally, although in the above-described embodiment a preload is applied to the pressure detecting element 4 by tightening the bolt 8, it is also possible that a pressing member having no screw structure is used in place of the bolt 8 so that the pressing member is put in the case 1 under pressure, or the case 1 is caulked after the pressing member is inserted thereinto, for applying a preload to the pressure detecting element 4. Yet additionally, it is also acceptable that, after the pressing member is inserted into the case 1, the pressing member is welded with the case 1 in a state where a preload is given to the pressure detecting element 4.

It should be understood that the present invention is not limited to the above-described embodiments, and that it is intended to cover all changes and modifications of the embodiments of the invention herein which do not constitute departures from the spirit and scope of the invention.

What is claimed is:

1. An ignition device for an internal combustion engine, comprising:

a spark plug made to carry out electric discharge between an center electrode and an earth electrode;

an ignition coil having a primary winding and a secondary winding for supplying a high voltage to said spark plug, with said spark plug and said ignition coil being mounted in a cylinder head of said internal combustion engine in an integrated condition;

a tube-like ceramic spool on which one of said primary winding and said secondary winding is wound;

two conductive connector terminals located at an axial end portion of said spool and connected to both end portions of said windings wound on said spool;

an insulating-resin-made holding member into which said two connector terminals are incorporated; and positioning means for inhibiting a relative motion of said connector terminals and said holding member with respect to said spool in circumferential directions of said spool.

2. The device according to claim 1, wherein said positioning means includes a notch portion made in said spool (52) and a projecting portion made in said holding member to engage with said notch portion.

3. The device according to claim 1, wherein said spool (52) is integrated with a ceramic plug side tube section internally accommodating said center electrode.

* * * * *